United States Patent [19]

Hams

[11] 4,034,973

[45] July 12, 1977

[54] AUTOMATED IN-LINE MAILING SYSTEM

[75] Inventor: Kenneth A. Hams, Nazareth, Pa.

[73] Assignee: Bell & Howell Company, Phillipsburg, N.J.

[21] Appl. No.: 642,276

[22] Filed: Dec. 19, 1975

[51] Int. Cl.[2] ..... B41F 13/56

[52] U.S. Cl. ..... 270/21; 83/210; 83/371; 270/58

[58] Field of Search ..... 83/61–63, 83/71, 367, 209–211, 371; 53/59 R; 270/21, 58, 71, 68 A

[56] References Cited

U.S. PATENT DOCUMENTS

| | | | |
|---|---|---|---|
| 3,857,220 | 12/1974 | Schneider | 83/371 |
| 3,897,051 | 7/1975 | Muller | 270/21 |

*Primary Examiner*—Edgar S. Burr
*Assistant Examiner*—A. Heinz
*Attorney, Agent, or Firm*—Griffin, Branigan & Butler

[57] ABSTRACT

An automated in-line mailing (AIM) system of the type comprising a continuous sheet web supply, a sheet cutter, a folder, a collector, and an envelope inserter is controlled by indicia on the sheet web. A control system includes a sensor for sequentially sensing the web indicia upstream of a cutting element and a particular arrangement of shift registers for storing signals representative of the indicia. The signals are shifted along the shift registers with movement of the web, and sheets cut therefrom, through the AIM system. The shift registers are sampled at various stages therealong to obtain signals for deactivating a web drive and activating insert stations. A clock signal for cutter and collector shift registers is provided by an endless tape which is normally used to control lengths of cuts by the sheet cutter.

In one embodiment the AIM system operates in a "two-up" mode wherein the cutter slits the sheet web to provide sheets travelling along two channels through the register, folder and collector to the inserter.

20 Claims, 5 Drawing Figures

AUTOMATED IN-LINE MAILING SYSTEM

BACKGROUND OF THE INVENTION

This invention relates generally to the art of sheet handling machines, and more specifically to such machines for preparing mass mailings.

Automated in-line mailing (AIM) systems have been designed including cutters, register tables, folders, collectors, and inserters. Normally in such a system, the cutter receives a preprinted sheet web which it cuts into individual sheets. These sheets are sequentially automatically fed to the register table, which straightens them and feeds them to a folder. The folder, in turn, folds the sheets into appropriate sizes and feeds them to a collector which collects the folded sheets until a set corresponding to one letter is collected. The collector then ejects, or "dumps" the set, or letter, onto an insert raceway which moves the letter through insert stations. Appropriate inserts are deposited at the insert stations onto the letter. Thereafter, the inserts and letters are stuffed into an envelope which is closed for mailing.

It has been proposed to place indicia on the preprinted sheet web to control operations of various elements of the above-described AIM system, and particularly to control which inserts are deposited on which letters.

A difficulty has been encountered in integrating operations of the various elements of an AIM system as described above under various circumstances even when the preprinted indicia is used. Thus, it is an object of this invention to provide an effective control system for controlling the various elements of an AIM system which responds to indicia preprinted on a web and which is flexible in operation.

Still another difficulty with prior art AIM control systems is that they operate unduly slowly. In this regard, the natures of the inserter and the collector of such a system are such that these systems normally must be driven asynchronously. Thus, the collector cannot always "dump" at predetermined time periods because it must wait until the inserter is in a proper "condition" for receiving a set or letter. The cutter, therefore, after cutting the sheets of a letter, must, in turn, pause to wait until the collector has received and dumped this letter before it can start cutting a new letter. This sometimes creates a relatively large time lag between the dumping of letters since both a register table and a folder table are often positioned between the cutter and the collector. This slows the whole operation of the system considerably and also underutilizes the inserter which can insert at a much higher rate than the other elements are providing letters. Thus, it is yet another object of this invention to provide an AIM system which is able to operate at a faster rate than those in the prior art and which utilizes the inserter to a greater degree.

Still another problem with prior art AIM systems is in properly placing their sheet-web scanners, or sensors, for picking up indicia from the sheet web and the complementary problem of properly placing the indicia on the sheet web. Both of these problems have several ramifications. Firstly, it is desirable to include on the sheet web large amounts of information for controlling all of the elements of the system, but on the other hand, large amounts of information normally requires multiple scanners or sensors to read it. Large numbers of scanners, in turn, take up large amounts of space. In this respect, it is desirable for scanners to be located below the web in some cases so that sheets can be printed on either side and "turnovers" of sheets can be avoided. However, if there are too many scanners, or if scanners are too large, positioning them below the web is difficult because of space requirements.

Secondly, it is desirable that when a web driver stops driving the web to cut the last page of a letter, the web driver is inhibited from starting to drive the next letter until the collector has dumped. To accomplish this, it has been proposed to place the web scanner close to the cutting blade. However, again, we run into a space problem in that there is very little room near the cutting blade.

Thirdly, there is the problem of how to space indicia on the web itself. If the indicia is side-by-side, it is difficult to include the indicia only on a margin that can be stripped from the web.

It is, therefore, still another object of this invention to avoid all of the above-mentioned space problems by providing an AIM system wherein: relatively few sensors can be used; the sensors can be spaced away from the cutting blade but yet can be used to hold the first page of the next letter at the cutting blade; and the indicia can be placed on margins which are slit from the web.

SUMMARY OF THE INVENTION

According to principles of this invention, a control system for controlling the flow of sheets through an AIM system is provided. The control system fully integrates operations of a cutter, a collector, and an inserter. The control system includes a scanner for sequentially reading a column of indicia on a supplied web upstream of the blade of the cutter. This information is placed on a cutter shift register and is clocked therealong by clock indicia on an endless tape which is also used to activate the cutter blade to cut the web at predetermined lengths. The cutter shift register is sampled so that when appropriate information is at the proper stage thereof a signal for inhibiting a web drive and the cutter is read. At this point, the first sheet of the next letter is ready to be fed to the cutter blade. When the web drive and cutter are restarted, the information in the cutter shift register is transferred to a collector shift register where it stays until the collector has received all sheets of this letter and has "dumped" these sheets onto an inserter raceway. Insert information is then transferred from stages of the collector shift register to respective inserter shift registers and each of these shift registers is continuously monitored by an insert station which drops an insert on a letter in response to information being at a particular stage of its shift register. When the collector dumps, it informs the cutter to begin operation again, and the cycle is repeated.

In a "two-up" embodiment of this invention, the cutter slits the web down the middle as well as cutting it into sheets, so that side-by-side sheets are produced. These sheets travel along side-by-side channels through the register, the folder, and the collector. The collector dumps the letters onto an inserter raceay at appropriate coordinated times. In the "two-up" embodiment, there are two cutter shift registers, and two collector shift registers.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENTS

Figure 1:
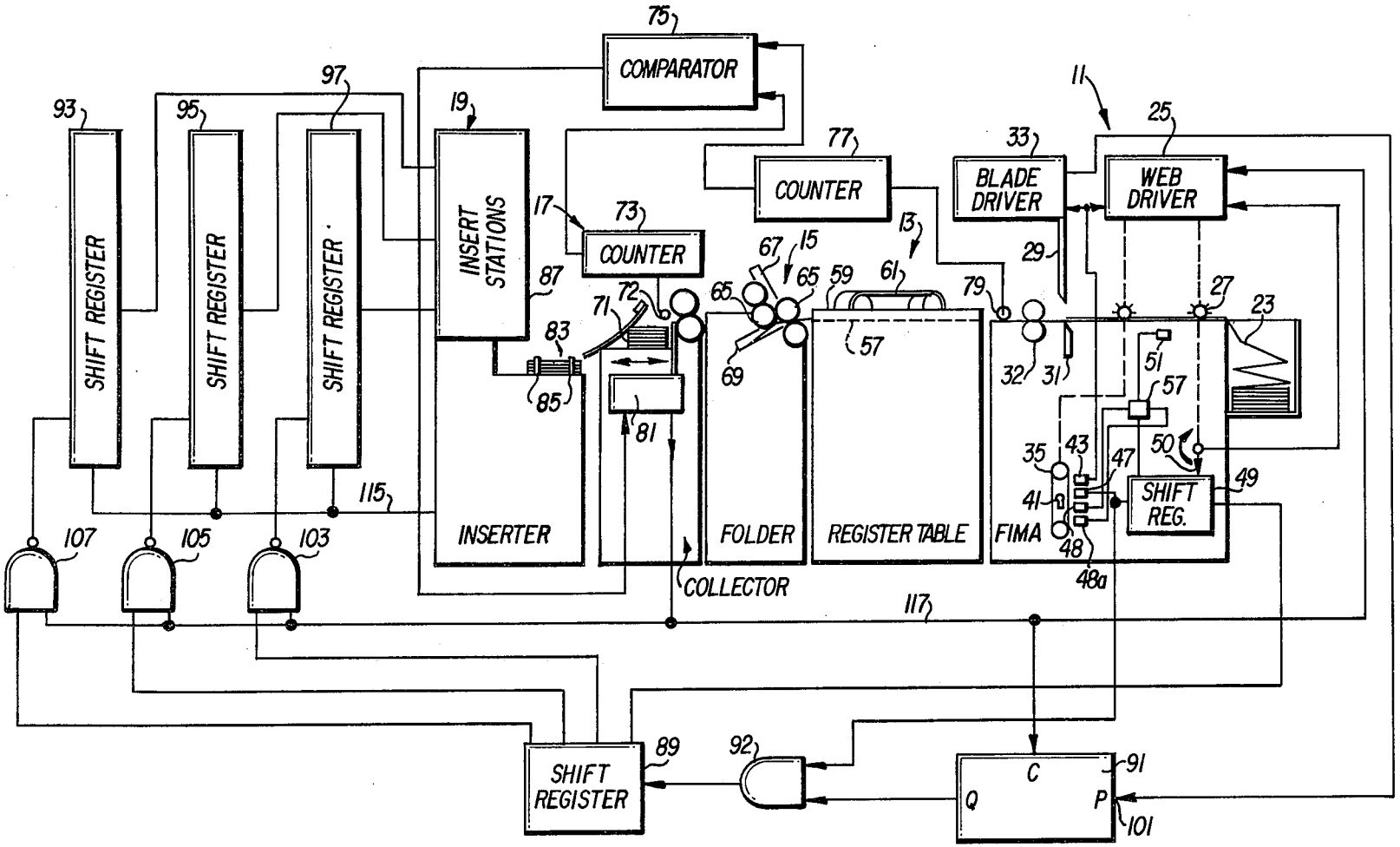
FIG. 1 is a partially block, partially schematic, side-view, diagram of an AIM system employing principles of this invention.
Figure 2:
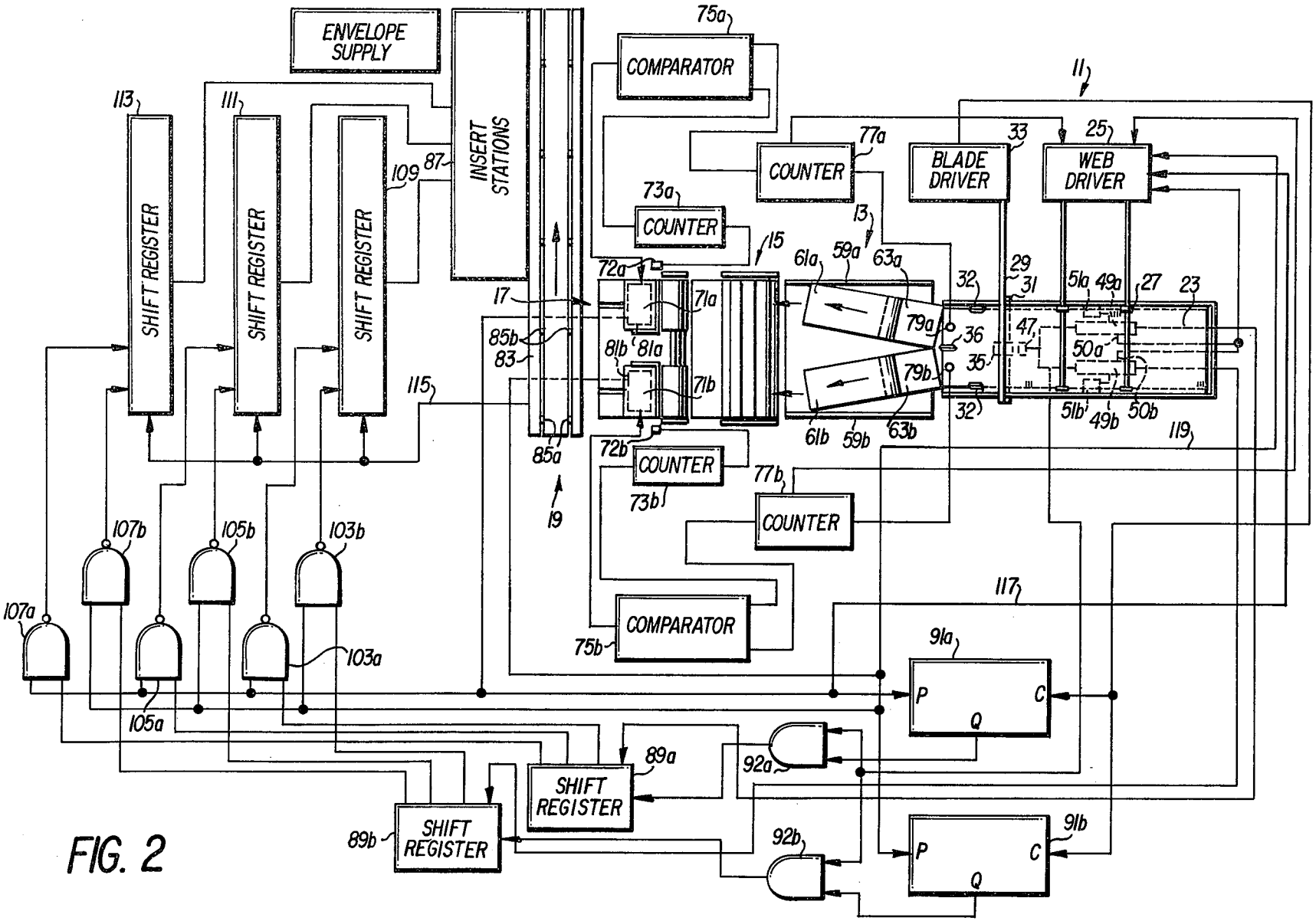
FIG. 2 is a partially block, partially schematic, top-view of a "two-up" embodiment of an AIM system employing principles of this invention.

Describing the "one-up" embodiment of FIG. 1 and the "two-up" embodiment of FIG. 2 together using the same names and numbers to designate similar elements, each of the AIM (automatic in-line mailing) systems comprises a standard, well-known, FIMA sheet-web cutter 11, a continuously-running register table 13, a standard, well known continuously-running buckle folder 15, a collector 17, an inserter 19, and a control system for integrating the operations of these various elements. The general operation of each of the AIM systems of FIGS. 1 and 2 is that the cutter 11 cuts a sheet web 23 into individual sheets (sheet pairs for the "two-up" embodiment of FIG. 2) which are registered by the register table 13, folded by the folder 15, and collected into sets or letters by the collector 17. The collector 17 then "dumps" the letters onto the inserter 19 which adds additional inserts to the letters and stuffs them and their inserts into envelopes.

Before describing the control system of the AIM system, the other elements of the AIM system will be described in more detail, again using the same names and numbers in describing similar elements of the "one-up" embodiment of FIG. 1 and the "two-up" embodiment of FIG. 2, but pointing out dissimilar elements.

The sheet-web cutter includes a web driver 25 having toothed wheels 27 which mesh with apertures 28 (FIGS. 4 and 5) in the margins of the sheet web 23 to drive the sheet web 23 toward a laterally cutting blade 29. The laterally cutting blade 29 is reciprocally driven down and up in cooperation with a stationary blade 31 by a blade driver 33 to cut sheets from the sheet web 23. Rotary side slitting blades 32 slit away margins 34 (FIGS. 4 and 5) of the web 23 which contain the aperatures 28 and preprinted indicia to be described below. The cutter 11 of the "two-up" embodiment of FIG. 2 further includes a center slitting blade 36 (FIG. 2) to slit sheets cut from the sheet web 23 into sheet pairs along a dotted line 38 in FIG. 5.

Figure 3:
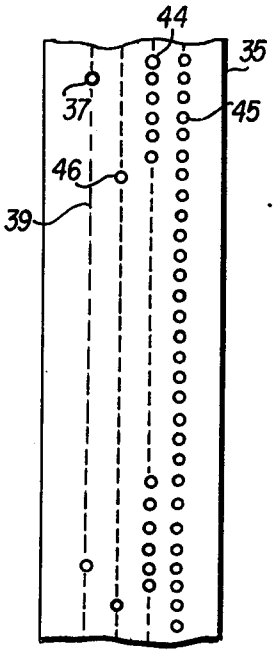
FIG. 3 is a top, fragmented view of an endless indexing tape of the AIM system of FIGS. 1 and 2.

The sheet-web cutter 11 of each of FIGS. 1 and 2 also includes an endless indexing tape 35 which is shown in more detail in FIG. 3. The indexing tape 35 is old in the art and is normally used to actuate the web driver 25 and blade driver 33 as follows: The indexing tape 35 is driven by the web driver 25 proportionately with the sheet-web 23 so that movement of the indexing tape 35 is indicative of the length of the sheet-web 23 that moves forward to the laterally cutting blade 29. The indexing tape 35 has holes 37 positioned along a longitudinal line or channel thereof, indicated by a dotted line 39 in FIG. 3, which corresponds to lateral cuts to be made by the laterally-cutting blade 29. A light source 41 (FIG. 1) is located on one side of the indexing tape 35 (depicted as being inside the tape 35 in FIG. 1) and a light sensor 43 is positioned adjacent to the light source 41 on the other side of the indexing tape 35. When a hole 37 is between the light source 41 and the light receiver 43, the light receiver is activated to provide a signal to the web driver 25 and the blade driver 33 to thereby stop the web driver 25, activate the laterally cutting blade 29 to cut a sheet from the sheet-web 23 of a predetermined length, and restart the web driver. In this regard, a photo cell, not shown, senses the completion of the cut sequence to initiate a new feed.

However, this invention contemplates the use of the indexing tape 35 for yet another purpose with the AIM control system which will be described in more detail below.

Examples of cutters 11 and the drivers therefor which could be used in this invention are disclosed in U.S. Pat. Nos. 2,866,428 to Stanfield, 3,760,669 to Rosenthal and 3,822,624 to Shoji.

Regarding the control system, three additional channels of holes 45, 44 and 46 (FIG. 3) are added to the indexing tape 35 and three additional light receivers 47, 48 and 48A (FIG. 1) are positioned on the opposite side of the indexing tape 35 from the light source 41 adjacent respectively to the holes 45 and 46. Thus, the light receiver 47 receives light every time a hole 45 comes between it and the light source 41, the light receiver 48 receives light every time a hole 46 comes between it and the light source 41 and the light receiver 48A receives light every time a hole 44 comes between it and the light source 41.

Describing first the "one-up" embodiment of FIG. 1 in more detail, the output from the light receiver 47 is used as a clock signal source to drive a cutter shift register 49. The cutter shift register 49 receives data from a light scanner 51 which is located adjacent to the sheet-web 23 upstream of the laterally cutting blade 29 and provides output data at a sampler 50. The output data detected by the sampler 50 is used to inhibit starting of the web driver 25 once it is stopped for a cut. In this regard, indicia or hyphans 53*a–f* (FIGS. 4 and 5) are positioned, or not positioned, in a column on that portion of the sheet-web 23 corresponding to the first page of a letter, or set, so as to pass over the light scanner 51 and be thereby read or not read by the light scanner 51. The positions of the hyphans 53*a–f* are synchronized with the holes 45 and 44 in the indexing tape 35. The light receiver 48A "enables" a gate 57 in response to detecting a hole 44 so that the information from a hyphen, such as 53*a*, is fed into the cutter shift register 49 as it passes over the light scanner 51. In the preferred embodiment, the gate 57 is a flip flop. The holes 46 on the indexing tape 35, on the other hand, are positioned at the end of a scanned area of each sheet to "disable" the gate 57 to prevent false mark signals from being used. However, subsequent sets of hyphens for the first pages of subsequent sheet sets, or letters, are thereafter allowed to be fed into the shift register and clocked therealong by signals from the light receiver 48A.

Figure 5:
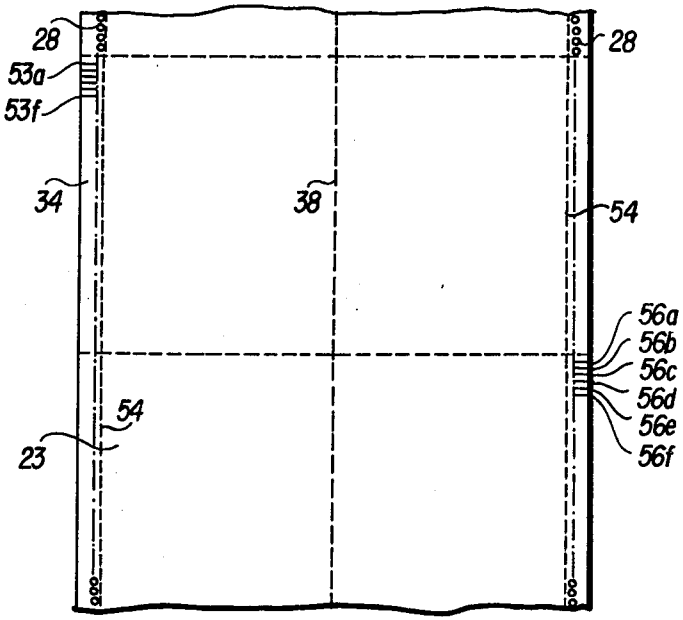

In the case of the "two-up" embodiment of FIG. 2, there are two cutter shift registers 49*a* and *b*, two light scanners 51*a* and *b* and two sets of hyphens 53*a–f* and 56*a –f* on the sheet web 23 (FIG. 5). In this case, the hyphens are positioned at the same longitudinal location for adjacent sheets, although only first sheets of letter sets have hyphens thereon.

Figure 4:
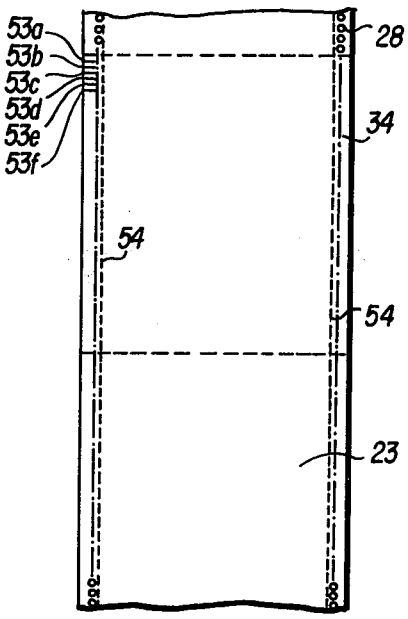
FIG. 4 is a fragmented view of a continuous sheet web being processed by the AIM system of FIG. 1 which is operating in the "one-up" mode; and, FIG. 5 is a fragmented view of a continuous sheet web being processed by the AIM system of FIG. 2 which is operating in the "two-up" mode.

As was noted above, the hyphens 53*a–f* and 56*a–f* are slit from the main sheets by the slitting blades 32 which cut along dotted lines 54 on FIGS. 4 and 5 and after they have been read by the light scanner 51.

Describing next the register table 13, the "one-up" register table of FIG. 1 comprises a flat surface 57, a registration wall 59, and an endless, diagonal conveyor 61. However, operation of the register table 13 can best be understood with reference to FIG. 2 which discloses a registration table for registering two sheets 63*a* and *b* simultaneously against oppositely positioned registration walls 59*a* and *b*. In essence, the endless, diagonal conveyor 61 (61*a* and *b* in FIG. 2) urges the sheets against the registration wall 59 (59*a* and *b* in FIG. 2) to thereby stabilize their positions and orientations prior to feeding them to the folder 15.

The buckle folder 15 is of a type well known in the art (See U.S. Pat. No. 3,856,293 to Boyer, for example) and includes sets of rolls 65 and buckle fold pans 67. Basically, sheets are driven by the rolls 65 into the fold pans 67 until they hit stops 69, whereupon they buckle and pass through a following set of rolls 65 into the next buckle fold pan and so on. It is not thought necessary to describe the buckle folder 15 in greater detail.

The register table 13 and the buckle folder 15 are continuously driven such that when a sheet is given to the register table 13 it is always transported without being otherwise controlled to the collector 17. Thus, the overall AIM control system, to be described below is applied to the cutter 11 and the collector 17, but not to the register table 13 and the folder 15 which are between the cutter 11 and the collector 17.

Regarding the collector 17, this unit receives folded sheets from the folder 15 and assembles them in a set 71, or sets 71*a* and *b* in the case of the "two-up" embodiment of FIG. 2. The sheets placed in the pile 71 are sensed by an optical sensor 72 and counted by a counter 73. The count from the counter 73 is fed to a comparator 75. Likewise, the comparator 75 receives a count from a counter 77 which is activated by a sensor 79 located at the output of the cutter 11. Thus, the counter 77 provides the comparator 75 with a count of how many sheets have been fed from the sheet-web cutter 11 toward the collector. When the comparator 75 detects that the same number of sheets are in the pile 71 as were sent from the cutter 11, it provides a signal to an ejector 81 which ejects the pile 71 onto a raceway 83 of the inserter 19.

In the case of the "two-up" embodiment of FIG. 2, there are two counters 73*a* and *b*, two comparators 75*a* and *b*, two counters 77*a* and *b*, and two sensors 72*a* and *b* and 79*a* and *b* to control the operations of two ejectors 81*a* and *b*. The ejectors 81*a* and *b* eject respective sets 71*a* and *b* onto the raceway 83.

The raceway 83 of the inserter 19 includes chain-driven pins 85 which are indexed in stepwise fashion through insert stations 87. It can be seen in FIG. 2 that in the "two-up" mode the piles 71*a* and *b* could both be dumped onto the raceway 83 in front of sets of pins 85*a* and *b* simultaneously. The pins are indexed on a regular cyclical basis past the collector 17 and the insert stations 87.

Turning now to the control system for the "one-up", FIG. 1, AIM system, which includes mainly the scanner 51 (FIG. 1), the cutter shift register 49 (described above), a collector shift register 89, insert shift registers 93, 95 and 97 and the circuits for these shift registers. The collector shift register 89 receives input data clocked from the output of the cutter shift register 49 by clocking signals from the light receiver 47 via an AND gate 92. In this regard, an inhibit circuit 91 allows clocking signals corresponding to one sheet only to drive the collector shift register 89, and inhibits subsequent clock signals from clocking information thereto. Thus, the collector shift register 89 receives and holds information on the first page of each letter set. The inhibit circuit 91 is driven to produce an output at terminal Q by a signal at terminal C from the ejector 81 at the time of "dumping" to start a new cycle and to end the output at Q in response to a signal at terminal P from the blade driver 33 at the time of a cut.

The collector shift register 89, thus, holds information concerning a letter until the ejector 81 ejects a set 71 onto the inserter raceway 83. At this point, the ejector 81 applies a signal to NAND gates 103, 104 and 107 to transfer the information on the various stages of the collector shift register 89 to respective first stages of inserter shift registers 93, 95 and 97. This information is then clocked along the inserter shift registers 93, 95 and 97 in time with movement of the chain-driven pins 85 as is indicated schematically by a line 115 in FIGS. 1 and 2. As a set of sheets comes to be positioned in front of a particular insert station, its corresponding signal is in a monitored stage of its corresponding shift register. The insert station either drops an insert on the set, or does not drop an insert on the set, in response to this information.

The ejector 81 also provides a signal along line 117 back to the web driver 25 starting up the web driver 25, and its cutter 11 in response to the ejector 81 ejecting a letter set, or pile 71 onto the raceway 83.

The "two-up" embodiment of FIG. 2 has two channels of cutter shift registers 49*a* and 49*b*, collector shift registers 89*a* and *b*, inhibiting circuits 91*a* and *b*, and AND gates 92*a* and *b*; however, there are the same number of inserter shift registers 109 111 and 113 as in the "one-up" mode of FIG. 1. In this regard, however, each of the inserter shift registers 109, 111 and 113 is preset with information in one stage of each of the collector shift registers 89*a* and *b* by two sets of NAND gates 103*a* and 105*a* and 107*a* and 103*b*, 105*b*, and 107*b*. For example, when an ejector 81*a* dumps, it drives the NAND gates 103*a*, 105*a* and 107*a* to pass the information from stages of the collector shift register 89*a* to the second stages of respective inserter shift registers 109, 111 and 113. Similarly, when the ejector 81*b* dumps, it drives the NAND gates 103*b*, 105*b* and 107*b* to pass the information from stages of the collector shift register 89*b* to the first stages of the respective insertor shift registers 109, 111 and 113. The information corresponding to the shift register 89*a* is preset into the insertor shift registers 109 111 and 113 further downstream than that corresponding to the shift register 89*b* because the ejector 81*a* dumps sets onto the raceway 83 further downstream than does the ejector 81*b*. Both of the ejectors 81*a* and *b* are connected back to the web driver 25 to start up the web driver 25 when either of them dumps.

Turning now to the overall operation of the "one-up" embodiment AIM system of FIG. 1, the sheet web 23 is fed into the sheet-web cutter 11 by the toothed-wheels 27 of the web driver 25 meshing with the apertures 28 (FIG. 4) in the margins of the sheet-web 23. The light scanner 51 scans the column on the sheet-web 23 where indicia or hyphens 53*a–f* appear. When the first page of a letter set passes over the light scanner 51, the hyphens on that page are read in sequence by the light scanner 51, and as they are read they are clocked onto the cutter shift register 49 by clock signals from the light receiver 47. Only the first page of each letter has hyphen indicia thereon. As each sheet on the sheet web 23 reaches the laterally cutting blade 29, the web driver 25 is stopped in response to a signal from the light receiver 43 and a cut is made by the laterally-cutting blade 29. At the same time, the sampler 50 samples the stage of the cutter shift register 49 which is, or is not, holding data at that point to further inhibit, or not inhibit, the web driver 25 from further operation. If the sampler 50 detects an inhibit signal, it will interrupt a start signal from a cut detector (not shown) and the web driver 25 will not be started. For example, assuming the "web-driver-inhibit" information is contained in hyphen 53*a* of FIG. 4, this information is in the stage of the cutter shift register 49 that is sampled by the sampler 50 when the first page is at the laterally cutting blade 29. The presence of information in this stage informs the web-drive to stop further operation of the web driver 25. When the sheet-web cutter 11 stops driving the sheet web 23, all of the data in the cutter shift register 49 is also held stationary since the indexing tape 35 is also no longer driven to produce clocking signals. This information is sufficient information to control the AIM system for the flow of the next letter to be cut and sent through the AIM system. It should be noted that there may be more than one page of material between the light scanner 51 and the laterally-cutting blade 29, and that the cutter shift register's length is therefore determined by the number of possible hyphen locations per page multiplied by the number of pages between the scanner and the blade.

Meanwhile, the last pages of the preceding letter continue to travel through the register table 13 and the folder 15 to the collector 17 until a full pile, or set, 71 is developed at the collector 17. This will be indicated when the count of the counter 73 and a counter 77 are equal as measured by the comparator 75. At this point, the comparator 75, which registers an equal count, orders the ejector 81 to eject the pile 71 onto the raceway 83 of the inserter 19.

Once the ejector 81 ejects, it informs the web driver 25 along the line 117 to begin operation once more. Simultaneously, it informs the inhibit circuit 91 to allow data to be shifted from the cutter shift register 49 to the collector shift register 89. Only one page of data is thusly transferred, however, because as soon as the blade driver 33 makes a cut, it informs the inhibit circuit 91 to stop the flow of clocking signals to the collector shift register through the AND gate 92. Thus, once the sheet web cutter 11 begins operation again, the information on the cutter shift register 49 is clocked into the collector shift register 89, however, further clock signals are inhibited by the inhibit circuit 91 after the first page of the set is cut. Since the collector shift register 89 receives serial hyphen information from the first sheet only of each material set, or letter, its length is equal to the number of possible hyphen positions on one sheet.

This information stays in the collector shift register 89 until the collector ejects the corresponding letter pile, or set, onto the raceway 83, at which time the ejector orders the NAND gates 103, 105 and 107 to preset the information from various stages of the collector shift register 89 directly into first stages of respective inserter shift registers 93, 95 and 97.

The information on the inserter shift registers 93, 95 and 97 is shifted along the shift registers proportionately as the set 71 corresponding to the information is moved along the raceway 83. When a set is in front of a particular insert station, the insert station reads the stage of an appropriate insert shift registers 93, 95 or 97 corresponding to that insert station and drops, or does not drop, an insert in accordance with the read information. After passing the insert stations 87, the letter sets and their newly acquired inserts are inserted into an envelope and further prepared for mailing.

Turning next to the overall operation of the "two-up" embodiment AIM system of FIG. 2, the sheet web 23 is fed into the sheet-web cutter 11 by the toothed-wheels 27 of the web driver 25 meshing with the aperatures 28 (FIG. 5) in the margins of the sheet-web 23.

In this case, there are two light scanners 51*a* and *b* which scan two columns on the sheet web 23 where indicia or hyphens 53*a–f* appear. When the first page pair of letters pass over the light scanners 51*a* and *b*, the hyphens on these page pairs are read in sequence by the light scanners 51*a* and *b*, and as they are read they are clocked onto the cutter shift registers 49*a* and *b* by clock signals from the light receiver 47. Only the first page of each letter has hyphen indicia thereon, and, in this regard, the first pages of adjacent letters on the sheet web 23 might not be side-by-side. As each sheet pair on the sheet web 23 reaches the laterally-cutting blade 29, the web driver 25 is stopped in response to a signal from the light receiver 43 and a cut is made by the laterally-cutting blade 29. At the same time, the samplers 50*a* and 50*b* sample the stages of the cutter shift registers 49*a* and *b* which are, or are not, holding data at that point to inhibit, or not inhibit, the web driver 25 from further operation. For example, assuming the "web-driver-inhibit" information is contained in a hypen 56*a* of FIG. 5, this information is in the stage of the cutter shift register 49*a* that is sampled by the sampler 50*a* as the first page arrives at the laterally-cutting blade 29. The presence of information in this stage informs the web-driver to prevent further operation of the web driver 25. Like-wise, information read in the cutter shift register 49*b* by the sampler 50*b* is used to stop the web driver 25. When the sheet-web cutter 11 stops driving the sheet web 23, all of the data in the cutter shift registers 49*a* and *b* is also held stationary since the indexing tape 35 is also no longer driven. It is possible that only one of the cutter shift registers 49*a* or *b* will have information therein corresponding to the first page of a new letter that is about to be cut. This information is sufficient to control the AIM system for the flow of the letter corresponding to this information.

Meanwhile, the last pages of preceding letters continue to travel through the register table 13 and the folder 15 to the collector 17 until a full letter pile, or set, 71*a* or *b* is developed at the collector 17. This will be indicated when either the count of the counters 73*a* and *b* or the counters 72*a* and *b* are respectively equal as measured by comparators 75*a* or *b*. At this point, the comparator 75*a* or *b* which registers an equal count, orders its respective ejector 81*a* or *b* to eject the full letter pile, or set, 71*a* or *b*, onto the raceway 83 of the inserter 19. It is possible that both of the piles 71*a* and *b* will be full at the same time and that they will both eject together, one ejecting its pile in front of a first set of pins 85*a* and the other ejecting its pile in front of a second set of pins 85*b*.

Once one of the ejectors 81*a* or *b* ejects, it informs the web driver 25 along the line 117 or 119 to begin operation once more. Simultaneously, it informs the appropriate inhibit circuit 91*a* or *b* to allow data to be shifted from an appropriate cutter shift register 49*a* or *b* to the appropriate collector shift register 89*a* or *b*. Only one page of data is thereafter shifted to the appropriate collector shift register 89*a* or *b*, however, because as soon as the blade driver 33 makes a cut for the first page of the letter, it informs the appropriate inhibit circuit 91*a* or *b* to stop the flow of clocking signals to the appropriate collector shift register 89*a* or *b* through the appropriate AND gate 92*a* or *b*. Thus, once the sheet web cutter 11 begins operation again, the information on the appropriate cutter shift register 49*a* or *b* is clocked into the appropriate collector shift register 89*a* or *b*, however, further clock signals are inhibited by the inhibit circuit 91*a* or *b* after the first page of the set is cut. Since the appropriate collector shift register 89*a* or *b* receives serial hyphen information from the first sheet only of each material set, or letter, its length is equal to the number of possible hyphen positions on one sheet.

Information stays in the collector shift register 89*a* or *b* until its respective ejector 81*a* or *b* ejects the next letter pile, or set, onto the raceway 83, at which time the appropriate ejector orders all of its NAND gates 103*a* or *b*, 105*a* or *b*, and 107*a* or *b* to preset the information from various stages of the appropriate collector shift register 89*a* or *b* directly into the first or second stages of respective inserter shift registers 109, 111 and 113. It should be noted that information from the collector shift register 89*a* is transferred to the inserter shift registers 109, 111 and 113 at points more downstream than information from the collector shift register 89*b*. This is so that the data on the inserter shift registers will correspond to the positions of the ejectors 81*a* and *b* relative to the raceway 83.

The information on the inserter shift registers 109, 111 and 113 is shifted along the shift registers proportionately as the set 71*a* or *b* corresponding to the information is moved along the raceway 83. When a set is in front of a particular insert station, the insert station reads the stage of an appropriate insert shift register 109, 111 or 113 corresponding to that inserter station and drops, or does not drop, an insert in accordance with the read information.

In the "two-up" embodiment of FIG. 2, it is possible that the ejector 81*b* will eject onto the raceway 83 in front of pins 85*a*, and the raceway will then be indexed so that this set is then positioned in front of the ejector 81*a*. When this occurs, an inhibit circuit (not shown) is provided to insure that the ejector 81*a* does not then eject on top of this set. Should the comparator 75*a* indicate that a full pile 71*a* is at the ejector 81*a*, but a set is positioned on the raceway 83 in front of the ejector 81*a*, the ejector 81*a* will not eject, but rather will wait until the raceway 83 indexes once.

After passing the insert stations 87, the letter sets and their newly acquired inserts are inserted into an envelope and further prepared for mailing.

It should be noted that the control system described herein provides easy coordination between the various components of the AIM system. Further, such coordination allows the use of the system with or without the register table 13 and the folder 15, and also allows the system to operate in either a "one-up" or a "two-up" mode of operation.

Inasmuch as this system allows a "two-up" mode of operation, it compensates for the otherwise slowness of operation of prior-art systems and helps to utilize the inserter 19 more efficiently.

In addition, by placing information read from the sheet web 23 on the cutter shift register 49 and then later sampling this information therefrom, the sensor 51 can be placed at a position which is not cramped and away from the laterally cutting blade 29. Also, by placing the information serially on a shift register, it is possible to use fewer sensors than in prior-art AIM systems which reduces the size of the sensing elements 51 and allows them to be used either under or over the sheet web 23. Similarly, by reading the information serially, all of the information can be placed on the sheet web 23 in a column along the margin thereof which can be later cut off of the sheet web 23.

While the invention has been particularly shown and described with reference to a preferred embodiment, it will be understood by those skilled in the art that various changes in form and detail may be made therein without departing from the spirit and scope of the invention. For example, a "two-up" AIM machine as is depicted in FIG. 2 could also be used in a "one-up" or single-channel, mode of operation.

The embodiments of the invention in which an exclusive property or privilege are claimed are defined as follows:

1. An automated in-line mailing system including:

a web supply means for supplying a sheet-web having indicia thereon;

a cutter means attached to said web-supply means for receiving said sheet web and cutting said sheet web into individual sheets, said cutter means including a drive means for driving said sheet web and a cutter control system communicating with said drive means for activating a cutting element at predetermined distances of travel of said sheet web past the cutting means;

a collector means for receiving said individual sheets from said cutter means, collecting said individual sheets into a pile, and thereafter asynchronously with said cutter means, depositing said pile with a receiving means; and, a control system including:

a sensor means for sensing said sheet-web indicia upstream of the cutting element;

a shift register attached to said sensor means for receiving and storing a signal in a first stage thereof in response to said sensor means detecting an indicia, said shift register being connected to said web-drive means and receiving signals therefrom for indexing stored signals through said shift register at a proportionate rate as said web-drive means drives said sheet web past said cutter means;

a sample-means for sampling a stage of said shift register, said sampler means being connected to the said web-drive means and inhibiting said web drive means in response to detecting a signal in said sample shift register stage; and, a reactivating means connected between said collector means and said web-drive means for reactivating said web-drive means in response to said collector means depositing said pile with said receiving means.

2. An automated in-line mailing system as claimed in claim 1 wherein said cutter control system includes an endless tape having columns of indicia thereon, said endless tape being linked to said web drive means and driven at a proportionate rate as said web-drive means drives said sheet web, and a stationary sensor located adjacent to said endless tape for sensing said indicia and activating said cutting element and clocking said shift register in response to said sensing.

3. An automated in-line mailing system as in claim 1 wherein a second shift register is serially attached to said first shift register for receiving data clocked out of said first register; wherein a plurality of inserter shift registers are attached to said second shift register, each for receiving data stored in one stage of said second shift register; and wherein a plurality of insert stations are attached to said inserter shift registers for dropping inserts onto piles or sheets on said receiving means in response to said data in said insert shift registers.

4. An automated in-line mailing system comprising:

a web supply means for supplying a sheet web having at least two columns of indicia thereon;

a cutter means attached to said web-supply means for receiving said sheet web, cutting said sheet web both longitudinally and transversely into dual, side-by-side individual sheets, said cutter means including a web-drive means for driving said sheet web and a cutter control system communicating with said web-drive means for activating a laterally-cutting element at predetermined distances of web travel;

a collector means for receiving said dual individual sheets from said cutter means, collecting said dual individual sheets into dual piles and thereafter individually depositing each of said dual piles with a receiving means;

a control system including:

a sensor means for sensing said sheet-web indicia upstream of said cutting element;

a delay means coupled between said sensor means and said drive means for deactivating said drive means after said web-drive means has conveyed said sheet web a predetermined distance after said sensor means has sensed an indicia; and, a reactivating means connected between said collector means and said web-drive means for reactivating said web-drive means in response to said collector means depositing either of said collector dual piles with said receiving means.

5. An automated in-line mailing system as in claim 4 wherein said sensor means includes two sensing elements and said delay means includes two delay elements each receiving a signal from one of the sensor elements and operating separately therefrom.

6. An automated in-line mailing system as claimed in claim 5 wherein each of said delay elements includes a first shift register.

7. An automated in-line mailing system as in claim 6 wherein said cutter control system includes an endless tape having columns of indicia thereon, said endless tape being linked to said web drive means and driven at a proportionate rate as said web-drive means drives said sheet web, and a stationary sensor located adjacent to said endless tape for sensing said columns of indicia and activating said laterally cutting element and for clocking said first shift registers in response to said sensing.

8. An automated in-line mailing system as in claim 7 wherein second shift registers are respectively serially attached to said first shift registers for receiving data clocked out of said first shift registers.

9. An automated in-line mailing system as in claim 4 wherein said cutter control system includes an endless tape having columns of indicia thereon, said endless tape being linked to said web drive means and driven at a proportionate rate as said web-driver means drives said sheet web, and a stationary sensor located adjacent to said endless tape for sensing said columns of indicia and activating said laterally cutting element and for clocking said delay means in response to said sensing.

10. An automated in-line mailing system as in claim 4 wherein shift registers are serially attached to said delay means for receiving data clocked out of said delay means.

11. An automated in-line mailing system including:

a web supply means for supplying a sheet web;

a cutter means attached to said web supply means for receiving said sheet web and activated for successively cutting said sheet web both longitudinally and transversely into dual individual sheet pairs;

a collecting means associated with said cutter means for receiving dual sheet pairs from said cutter means and collecting individual sheets of dual sheet pairs into separate dual piles and thereafter ejecting said piles from said collecting means; and a control system means connected between said cutter means and said collecting means for controlling the flow of said sheet web and individual sheet pairs through said automated in-line mailing system, said control system means including a deactivating means for deactivating said cutter means and a reactivating means for reactivating said cutter means in response to said collector means ejecting either of said piles.

12. An automated in-line mailing system as in claim 11 wherein is further included an interface means for transporting sheets between said cutter means and said collecting means including a sheet registration means having parallel, oppositely-positioned, registration walls on opposite sides of a sides of a sheet path, said sheet registration means being coupled to said cutter means for receiving dual sheet pairs from said cutter means and registering individual sheets of said dual sheet pairs against said oppositely-positioned registration walls.

13. An automated in-line mailing system as in claim 12 wherein said interface means further includes a folding means coupled to said sheet registration means for receiving registered dual sheet pairs and folding individual sheets thereof.

14. An automated in-line mailing system as in claim 13 wherein said sheet web has indicia thereon and wherein said control system means comprises:

a sensor means for sensing said sheet-web indicia upstream of said cutter means;

a delay means coupled between said sensor means and said cutter means for deactivating said cutter means when said sheet web has travelled a predetermined distance after said sensor means has sensed an indicia thereon; and, a reactivating means connected between said collector means and said cutter means for reactivating said cutter means in response to said collector means ejecting either of said collected dual piles.

15. An automated in-line mailing system as in claim 11 wherein said sheet web has indicia thereon and wherein said control system means comprises a sensor means for sensing said sheet-web indicia upstream of said cutter means;

a delay means coupled between said sensor means and said cutter means for deactivating said cutter means when said sheet web has travelled a predetermined distance after said sensor means has sensed an indicia thereon; and, a reactivating means connected between said collector means and said cutter means for reactivating said cutter means in response to said collector means ejecting either of said collected dual piles.

16. A method of controlling an in-line sheet-web cutter which cuts a moving sheet web having indicia thereon into individual sheets and a collector which receives the individual sheets from the sheet-web cutter, collects them into a pile, and ejects the pile comprising the steps of:

transporting the sheet web past said cutter, cutting individual sheets therefrom with said cutter, and transporting said individually cut sheets from said cutter to said collector;

sensing indicia at predetermined locations on the sheet web upstream of said cutter and generating discrete signals corresponding to said indicia;

storing said signals in a storage means and moving the stored signals within said storage means to positions which represent the movement of said predetermined locations on said sheet web;

sampling a position within said storage means for detecting the presence of a stored signal after said sheet web has travelled a predetermined distance from the time the indicia was sensed and stopping the movement of said sheet web and the cutter in response to the detection of said stored signals while continuing to transport said individual, cut sheets from said cutter to said collector;

ejecting a pile of sheets from the collector once the collector receives all individual sheets that were cut by the cutter prior to stopping movement of the sheet web; and starting the movement of the sheet web and the cutter in response to the collector ejecting said pile.

17. A method of controlling an in-line sheet web cutter as in claim 16 wherein are further included the steps of:

registering individual, cut sheets against a wall after they have been cut; and, thereafter folding said sheets before they are collected into piles.

18. A method as in claim 16 wherein is further included the step of shifting stored signals along a shift register in said storage means, and sampling only the stage of said shift register in which this signal should be after said sheet web has travelled said predetermined distance.

19. An automated in-line mailing system including:

a web supply means for supplying a sheet web having indicia thereon;

a cutter means attached to said web-supply means for receiving said sheet web and cutting said sheet web into individual sheets, said cutter means including a web-drive means for driving said sheet web and a cutter control system communicating with said drive means for activating a cutting element at predetermined distances of travel of said sheet web past said cutter means;

a collector means for receiving said individual sheets from said cutter means, collecting said individual sheets into a pile, and thereafter depositing said pile onto an inserter raceway;

an inserter, including said inserter raceway and further including inserter stations through which said raceway transports said pile for dropping inserts onto said pile; and, a control system including:

a sensor means for sensing said sheet-web indicia upstream of said cutting element;

a shift register attached to said sensor means for receiving and storing a signal in a first stage thereof in response to said sensor means detecting an indicia, said shift register being connected to said drive means and receiving signals therefrom for indexing stored signals through said shift register at a proportionate rate as said web-drive means drives said sheet web past said cutter means, a sampler means for sampling a last stage of said shift register, said sampler means being connected to said web-drive means and deactivating said web drive means in response to detecting a signal in said sampled shift-register stage;

a reactivating means connected between said collector means and said web-drive means for reactivating said web-drive means in response to said collector means depositing said pile;

a collector shift register for receiving stored signals clocked from said cutter shift register and holding said signals until said collector means deposits said pile; and, inserter shift registers for receiving said information from said collector shift register when said collector means deposits said pile and for shifting said information along said inserter shift registers at a proportionate rate as said pile is moved along said raceway;

said inserter including a sampling means for each of the inserter stations for sampling an appropriate stage of one of said shift registers, said inserter stations responsing to their respective sampling means detecting information in said sampled stages by placing an insert on a pile.

20. An automated in-line mailing system as in claim 19 wherein said inserter shift register is clocked by a signal received from a raceway drive means.

* * * * *

UNITED STATES PATENT AND TRADEMARK OFFICE

CERTIFICATE OF CORRECTION

PATENT NO. : 4,034,973

DATED : July 12, 1977

INVENTOR(S) : Kenneth A. Hams

It is certified that error appears in the above-identified patent and that said Letters Patent are hereby corrected as shown below:

Column 2, line 65, correct the spelling of "race-way"; Column 3, bridging lines 63 and 64, correct the spelling of "apertures"; Column 4, lines 56 and 61, correct the spelling of "hyphens"; Column 6, line 54, after "109" insert a comma; Column 7, line 2, after "109" insert a comma, and line 37, change "web-drive" to --web driver--; Column 11, line 3, change "sample-means" to --sampler means--, line 7 change "sample" to --sampled--, line 32, change "insert" to --inserter--; Column 12, line 58, delete "of a side"; Column 13, line 51, change "signals" to --signal--; Column 14, line 60, change "responsing" to --responding--.

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*